US007481599B2

(12) United States Patent
Stice

(10) Patent No.: US 7,481,599 B2
(45) Date of Patent: Jan. 27, 2009

(54) BOLLARD TYPE BARRIER ASSEMBLY

(76) Inventor: David L. Stice, 3701 Maple Ave., Odessa, TX (US) 79762

( * ) Notice: Subject to any disclaimer, the term of this patent is extended or adjusted under 35 U.S.C. 154(b) by 0 days.

(21) Appl. No.: 11/800,226

(22) Filed: May 4, 2007

(65) Prior Publication Data

US 2007/0258762 A1 Nov. 8, 2007

Related U.S. Application Data

(60) Provisional application No. 60/798,073, filed on May 4, 2006.

(51) Int. Cl.
*E06B 11/00* (2006.01)

(52) U.S. Cl. ..... 404/6; 49/131

(58) Field of Classification Search ..... 49/33, 49/49, 131, 35; 404/6
See application file for complete search history.

(56) References Cited

U.S. PATENT DOCUMENTS

| | | | | | |
|---|---|---|---|---|---|
| 3,564,769 | A * | 2/1971 | Wilson et al. | ..... | 49/35 |
| 3,660,935 | A * | 5/1972 | Boots | ..... | 49/35 |
| 3,698,135 | A * | 10/1972 | Boots et al. | ..... | 49/35 |
| 4,003,161 | A * | 1/1977 | Collins | ..... | 49/35 |
| 4,715,742 | A * | 12/1987 | Dickinson | ..... | 404/6 |
| 4,919,563 | A | 4/1990 | Stice | | |
| 5,474,017 | A * | 12/1995 | Mohebbi et al. | ..... | 116/209 |
| 5,476,338 | A * | 12/1995 | Alberts | ..... | 404/6 |
| 5,961,249 | A * | 10/1999 | Hansen et al. | ..... | 404/9 |
| 5,975,792 | A * | 11/1999 | Goeken et al. | ..... | 404/6 |
| 6,065,900 | A | 5/2000 | Reale | | |
| 6,099,200 | A | 8/2000 | Pepe et al. | | |
| 6,409,419 | B1 * | 6/2002 | Hernandez | ..... | 404/6 |
| 6,550,294 | B2 * | 4/2003 | Garguilo | ..... | 70/168 |
| 6,821,050 | B1 * | 11/2004 | Maldonado | ..... | 404/6 |
| 6,997,638 | B2 | 2/2006 | Hensley et al. | | |
| 7,244,075 | B2 * | 7/2007 | Stadler | ..... | 404/6 |
| 2005/0031411 | A1 | 2/2005 | Hensley | | |

* cited by examiner

*Primary Examiner*—Gary S Hartmann
(74) *Attorney, Agent, or Firm*—Scott D. Compton

(57) ABSTRACT

The present application relates to a barrier assembly used to block access, improve security, and landscape property. The barrier assembly comprises at least a support assembly so configured to secure to the ground; a retractable assembly so configured to be received within the support assembly; and a locking assembly attached to the retractable assembly, the locking assembly comprising (a) a locking rod assembly configured to hold the retractable assembly in at least a first fixed position, (b) a tamper proof lock configured to maintain the orientation of the locking rod assembly, and (c) a locking tool configured to access the tamper proof lock and adjust the locking rod assembly so that the retractable assembly can be adjusted from the first fixed position to a second fixed position.

12 Claims, 4 Drawing Sheets

BOLLARD TYPE BARRIER ASSEMBLY

CROSS-REFERENCE TO RELATED APPLICATIONS

The application is entitled to the benefit of the filing date of the prior-filed provisional application No. 60/798,073, filed on May 4, 2006.

STATEMENT REGARDING FEDERALLY SPONSORED RESEARCH OR DEVELOPMENT

Not applicable.

FIELD OF THE APPLICATION

The application relates generally to a bollard type barrier assembly used for example, to block access, to improve security, and to add value to the landscape of property.

BACKGROUND

Post or bollard type barriers are employed to control access to entranceways, driveways, roads and the like, and to also secure the perimeter around buildings, structures, and other objects. Typically, post or bollard type barriers control access by extending above grade a distance necessary to prevent traffic flow, such as vehicles, from traveling beyond the barrier.

Depending on the situation, a post or bollard type barrier may be either stationary thereby maintaining a constant above grade position, or retractable, wherein the post or bollard can be interchangeably positioned from an above grade extended position to a below grade retracted position whereby the bollard can be locked in position to allow vehicles or other objects access beyond the barrier.

In instances where a vehicle or other object impacts a bollard that is extended above grade, energy from the impact may travel along the length of the bollard toward the surrounding ground or support structure resulting in structural damage to either or both the barrier and the ground or support structure. Often, the damage results in the bollard and the surrounding ground or support structure being repaired and/or replaced. Post impact repairs to the bollard and surrounding ground or support structure can be time consuming and costly.

In other instances, vibration associated with the passage of vehicles over or near a retracted bollard may cause the retracted bollard to unintentionally unlock and extend out from a locked position below grade to an extended position above grade—potentially resulting in unwanted collisions between the bollard and a vehicle or other object.

A bollard type barrier is desired that decreases or otherwise eliminates damage to the surrounding ground or support structure following impact while also protecting against unintentionally unlocking or potential extension of the barrier above grade.

SUMMARY

The present application is related to a barrier assembly comprising of at least (1) a support assembly so configured to be secured to the ground; (2) a retractable assembly so configured to be received within the support assembly; and (3) a locking assembly so configured to attach to the retractable assembly. The locking assembly suitably comprises (a) a locking rod assembly configured to hold the retractable assembly in at least a first fixed position, (b) a tamper proof lock configured to maintain the orientation of the locking rod assembly, and (c) a locking tool configured to access the tamper proof lock and adjust the locking rod assembly so that the retractable assembly can be adjusted from the first fixed position to a second fixed position. Various embodiments of the barrier assembly and methods for employing the barrier assembly are provided herein.

BRIEF DESCRIPTION

Figure 1:
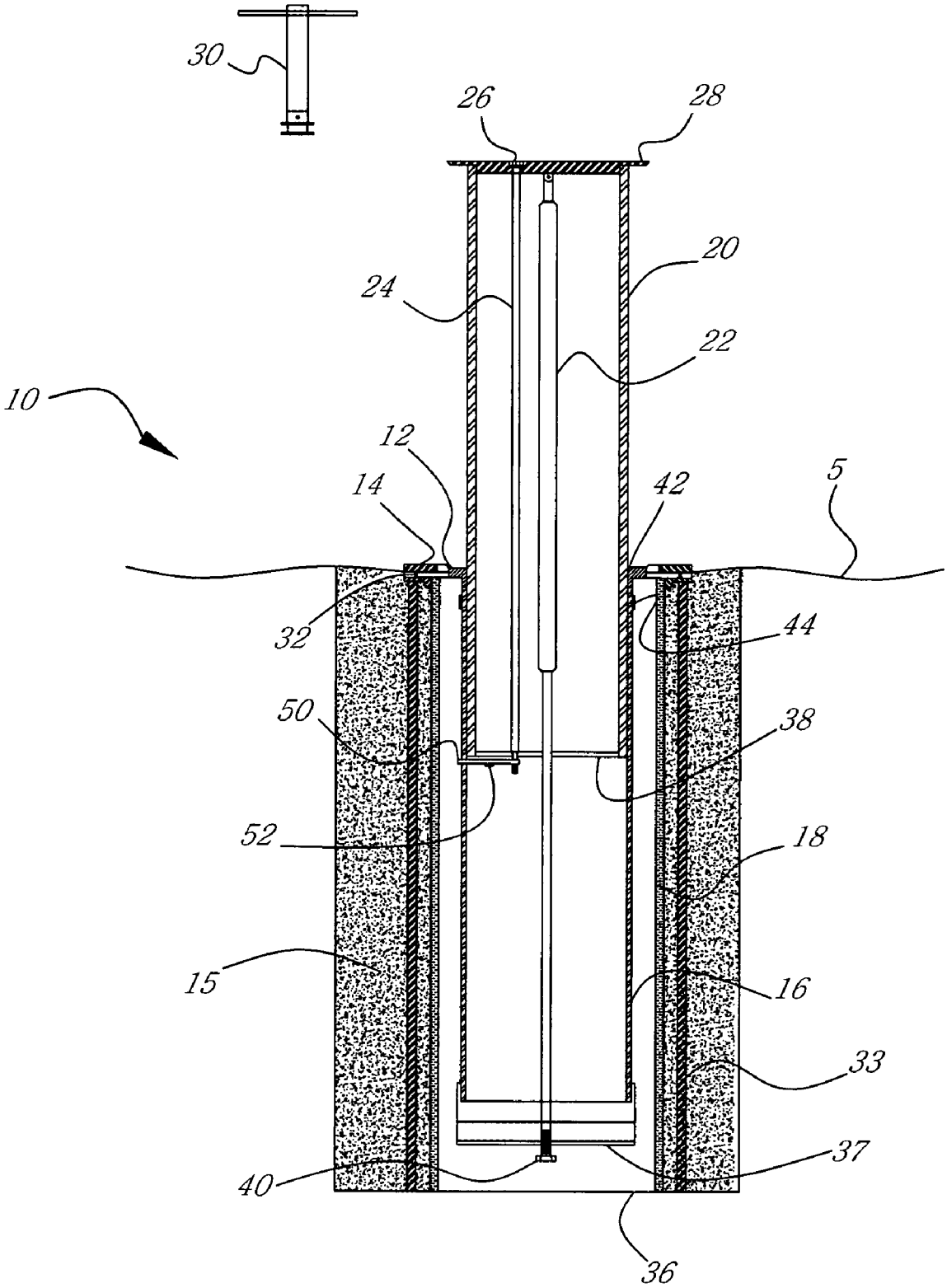
FIG. 1 illustrates a cross-sectional side view of the barrier assembly wherein the bollard is fixed in an extended position above grade.

It has been discovered that a bollard type barrier assembly, supported below grade and operationally configured to extend above grade, can absorb an impact from a moving vehicle or other object and limit or isolate the resulting impact and possible damage resulting there from to the bollard itself without distributing energy or otherwise damaging the surrounding ground or support structure. By limiting or isolating the damage to the bollard, the bollard can be removed and replaced without having to repair or replace the surrounding ground or support structure. Heretofore, such a desirable achievement has not been considered possible, and accordingly, the barrier assembly described herein measures up to the dignity of patentability and therefore represents a patentable concept.

Before describing the invention in detail, it is to be understood that the present barrier assembly and method are not limited to particular embodiments. It is also to be understood that the terminology used herein is for the purpose of describing particular embodiments only, and is not intended to be limiting. As used in this specification and the appended claims, the phrase "barrier assembly" refers to one or more bollard type barriers operationally configured as described herein. The term "ground" refers to any travel surface including but not necessarily limited to the earth and manmade structures such as bridges, building surfaces such as rooftops and walls, platforms and the like that can be constructed of various materials including for example, metals, woods, plastics, composites, and cementitious materials. The term "ground" can also include any of the above travel surfaces including surfaces about horizontal up to about vertical, such as a wall. The term "grade" refers to ground level. The term "impact" refers to any contact between a barrier assembly extending above grade and a vehicle or other object. For example, a typical impact between an automobile and a barrier assembly described herein may occur at a point along the bollard from about 12 inches to about 24 inches above grade—depending on the length of the bollard and the vehicle impacting the bollard. The term "vehicle" herein refers to not only automobiles, but to any conveyance means configured to transport people or other objects including, for example, military conveyances such as tanks, construction trucks, steamrollers, tractors, locomotives, sleds, and other land traveling crafts. Vehicle can further include water crafts such as boats and the like in situations where the barrier assembly is employed in water. The phrase "rapid removal" or "rapid removal and replacement" herein refers to removing or removing and replacing at least the retractable assembly of the barrier assembly, but the phrase may also include removing or removing and replacing part of the support assembly along with the retractable assembly within minutes. The phrase "cementitious material(s)" herein refers to materials typically required to make concrete or other cement based products. The phrase "camouflage" herein means to conceal by some means that alters or obscures the appearance of an object.

In one aspect, the present application relates to a bollard type barrier assembly configured to stop a moving vehicle at the point of impact of the vehicle with the barrier assembly.

In another aspect, the present application relates to a bollard type barrier assembly configured for rapid removal and replacement of the retractable part of the barrier assembly.

In another aspect, the present application relates to a bollard type barrier assembly configured so that impact energy can be transferred to the retractable assembly away from the surrounding ground or support structure.

In another aspect, the present application relates to a bollard type barrier assembly including a locking assembly operationally configured to hold the retractable assembly in a fixed position either above grade or below grade.

In another aspect, the present application relates to a bollard type barrier assembly including a camouflaged locking assembly.

In another aspect, the present application relates to a bollard type barrier assembly including a tamper proof locking assembly.

In another aspect, the present application relates to a bollard type barrier assembly including a tamper proof locking assembly including a hand tool configured to access the tamper proof locking assembly.

In another aspect, the present application relates to a bollard type barrier assembly including a tamper proof locking assembly including a tool configured to adjust the locking assembly between a locked position and unlocked position of the retractable assembly.

In still another aspect, the present application relates to a bollard type barrier assembly including a support assembly comprised of a plurality of flanges in a bulls-eye configuration at about ground level and surrounding the bollard.

In yet another aspect, the present application relates to a method of employing the bollard type barrier assembly.

In another aspect, the present application relates to a method of employing a plurality of adjacent bollard type barrier assemblies spanning the width of a particular pathway.

The barrier assembly according to the present application will be described in more detail with reference to the embodiments illustrated in the drawings. The drawings are illustrative only, and are not to be construed as limiting the invention.

The Barrier Assembly

The Figures of the drawings, and particularly FIG. 1, disclose a barrier assembly 10 comprising (1) a support assembly operationally configured to be secured to the ground to a predetermined depth; (2) a retractable assembly operationally configured to be received within the support assembly; and (3) a locking assembly operationally configured to hold the retractable assembly in a fixed position.

At a minimum, the support assembly is comprised of a multi-flange assembly including at least an inner most flange 12 and one or more outer flanges 14; a casing 16 set below grade and configured to affix to the inner most flange 12 at a first end; a housing 18 set below grade surrounding the casing 16; and reinforced cementitious material 15 comprising a framing network disposed therein, the reinforced cementitious material 15 being configured to adhere to the multi-flange assembly and the housing 18, wherein the housing 18 is operationally configured to isolate the casing 16 from the reinforced cementitious material 15.

At a minimum, the retractable assembly is comprised of a telescoping bollard 20 operationally configured to (1) extend out from the casing 16, and (2) retract into the casing 16; and an actuating member 22 configured to urge the bollard 20 from a first fixed position to a second fixed position (i.e., from a first position of the bollard 20 below grade to an extended position of the bollard 20 above grade).

At a minimum, the locking assembly is comprised of a locking rod assembly including an adjustable locking rod 24 configured to hold the retractable assembly in a fixed position below grade or above grade; a tamper proof lock 26 configured to maintain the orientation of the locking rod 24 against any undesired motion; a tamper proof cap 28 attached to a first end of the bollard 20 and configured to house the tamper proof lock 26; and a locking tool 30 configured to access the tamper proof lock 26 to adjust the locking rod 24.

Support Assembly

In one suitable implementation, the support assembly can be operationally configured to reinforce the retractable assembly, including the locking assembly, during impact when the bollard 20 is in an extended position above grade. In another suitable implementation, the support assembly can be operationally configured for the rapid removal and replacement of the retractable assembly following an impact—including impact destructive to the retractable assembly.

As illustrated in FIG. 1, the support assembly, including at least the reinforced cementitious material 15, casing 16 and housing 18, can be secured to the ground below grade. As further illustrated in FIG. 1, the multi-flange assembly of the support assembly can be located at about grade wherein at least part of the multi-flange assembly can be adhered to or otherwise joined to the reinforced cementitious material 15 along the below grade side of the multi-flange assembly. In addition, the casing 16 can be affixed to the inner most flange 12 at a first end wherein the casing 16 suitably extends below grade and terminates at a depth about equal to the deepest section of reinforced cementitious material 15 wherein the casing 16 is surrounding by the housing 18.

In one suitable embodiment of the barrier assembly 10, the multi-flange assembly comprises two or more flanges oriented in a "bulls-eye" configuration wherein the outer periphery of the inner most flange 12 abuts the inner periphery of an adjoining outer flange 14. Likewise, the inner periphery of each successive outer flange suitably abuts the outer periphery of the adjoining inner flange. In addition, the flanges may include gaskets there between.

Figure 2A:
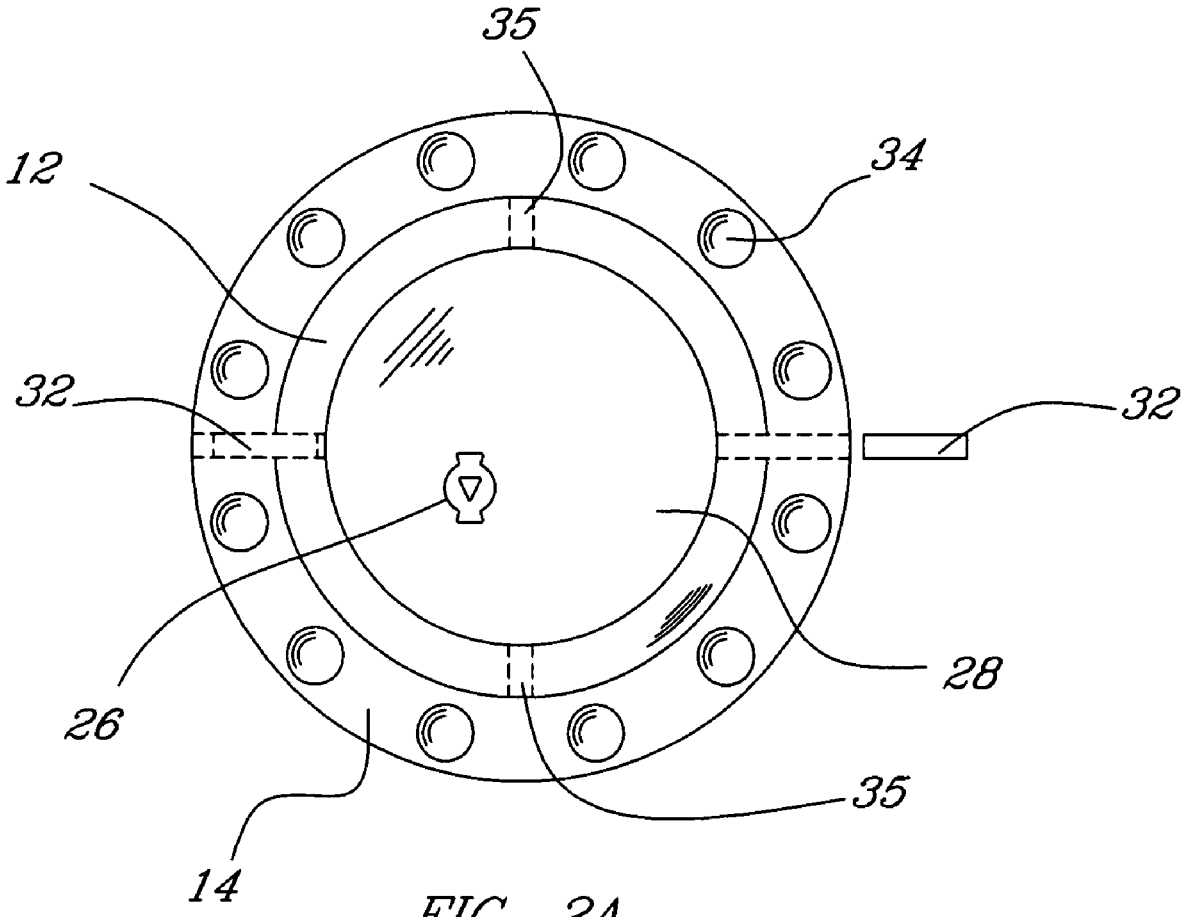
FIG. 2A illustrates a top view of the barrier assembly wherein the bollard is positioned below grade.
Figure 2B:
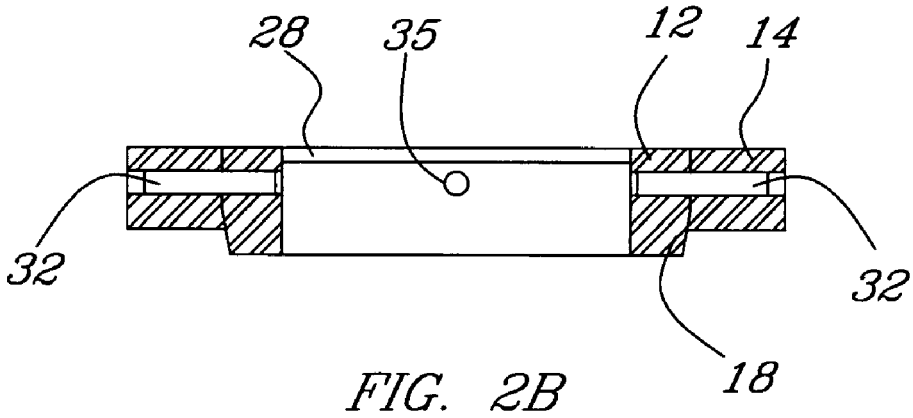
FIG. 2B illustrates a cross-sectional side view of the multi-flange assembly of the support assembly.

In another suitable embodiment of the barrier assembly 10, the multi-flange assembly comprises at least an inner most flange 12 releasably secured to an adjoining outer flange 14 via a locking means, including but not necessarily limited to, one or more locking pins 32. As FIGS. 2A and 2B illustrate, the one or more locking pins 32 can be housed within corresponding recesses of the flanges 12 and 14 in an overlapping manner to effectively secure or otherwise lock the inner most flange 12 to the outer flange 14 to guard against undesired rotational movement of the inner most flange 12 and guard against undesired separation of the inner most flange 12 from the outer flange 14—thus preserving the alignment between flanges 12 and 14 during operation of the barrier assembly 10.

In one embodiment, the recess of the inner most flange 12 can include a hole in the outer periphery of the inner most flange 12. In another embodiment, the recess of the inner most flange 12 can include a machined slot or groove along the below grade side of the inner most flange 12 beginning at the outer perimeter of the inner most flange 12 and terminating with a hole configured to receive at least part of the locking pin 32. In a suitable locked position of the multi-flange assembly as described herein, at least part of one end of the locking pin 32 may extend into the recess of the outer flange 14, while at least part of the locking pin 32 rests along the length of the machined slot or groove of the inner most flange 12, while at least part of the other end of the locking pin 32 extends into the recess of the inner most flange 12. Suitably, the recess of the outer flange 14 includes a depth that allows each locking pin 32 to be slid radially into the recess of the outer flange 14 a distance necessary to withdraw the locking pin 32 from the inner most flange 12—or vice versa.

The one or more locking pins 32 may also be spring loaded originating from either the inner most flange 12 or the adjoining outer flange 14. In a particularly advantageous embodiment of the barrier assembly 10 incorporating spring loaded locking pins 32, the one or more locking pins 32 are operationally configured to spring out from the outer flange 14 to mate with corresponding recesses of the inner most flange 12. In this embodiment, each spring loaded locking pin 32 can be manually slid radially into the recess of the outer flange 14 a distance necessary to withdraw the locking pin 32 from the inner most flange 12.

The multi-flange assembly described herein may further comprise one or more support pins 35 fixed to the adjoining outer flange 14. Suitably, the one or more support pins 35 can be configured in such a manner that the inner most flange 12 can sit atop the one or more support pins 35 wherein the casing 16 that is affixed to the inner most flange 12 can suspend from the inner most flange 12 to a point below grade within the housing 18. To best accommodate the one or more support pins 35, the below grade side of the inner most flange 12 may include one or more machined slots or grooves configured to receive at least part of each of the support pins 35 to assist in stabilizing and holding the inner most flange 12 as described above. Thus, during operation of the barrier assembly 10, the multi-flange assembly may be effectively secured by not only locking the inner most flange 12 to the adjoining outer flange 14 via one or more locking pins 32, but also by further mating the support pins 35 with the slots or grooves of the inner most flange 12.

In a particularly advantageous embodiment, the multi-flange assembly may comprise (a) a pair of corresponding recesses on each of the flanges 12 and 14 that are set about 180° apart—each pair of corresponding recesses being operationally configured to house at least part of a locking pin 32 therein; and (b) two support pins 35 fixed to the first outer flange 14 and set about 180° apart. As shown in FIG. 2A, when the multi-flange assembly is in an operational position, each of the four pins 32, 35 lie about 90° apart along the outer periphery of inner most flange 12. A different number of locking pins 32 and/or support pins 35 can be used if desired or otherwise required.

Depending on the desired use of the barrier assembly 10, suitable locking pins 32 may be comprised of durable materials effective to preserve the alignment of multi-flange assembly during operation of the barrier assembly 10. Suitable locking pin 32 materials include for example, metal industrial materials such as stainless steel and carbon steel. In one particularly advantageous embodiment, the one or more locking pins 32 are comprised of stainless steel dowel pins. In another particularly advantageous embodiment, the one or more locking pins 32 are comprised of carbon steel dowel pins. Suitable locking pins 32 can be acquired from the following commercial sources: Grainger®; and Small Parts, Inc., Miami Lakes, Fla.

Although the barrier assembly 10 can be built to scale, in order to prevent access of vehicles of the type described herein, the locking pins 32 suitably comprise a diameter of from about 0.95 cm (about ⅜ inch) to about 1.9 cm (about ¾ inch), and comprise a length from about 7.6 cm (about 3 inches) to about 9.50 cm (about 3¾ inches). In a particularly advantageous embodiment, the barrier assembly 10 includes spring loaded locking pins 32 each comprising a diameter of about 1.27 cm (about ½ inch) and a length of about 8.90 cm (about 3½ inches) with corresponding recesses on the flanges 12 and 14 having the following dimensions:

Recess of Outer Flange 14:

| | | |
|---|---|---|
| Width: | about 1.43 cm | (about 9/16 inches) |
| Depth: | up to about 6.35 cm | (up to about 2½ inches) |

Recess of Inner Most Flange 12:

| | | |
|---|---|---|
| Width of Hole: | about 1.43 cm | (about 9/16 inches) |
| Depth of Hole: | about 0.64 cm | (about ¼ inches) |
| Width of Machined Groove: | about 1.43 cm | (about 9/16 inches) |
| Length of Machined Groove: | about .953 cm | (about ⅜ inches) |

When the multi-flange assembly is locked in an operational position, the one or more locking pins 32 suitably extend within the recesses of the inner most flange 12 and the outer flange 14 up to about 0.64 cm (about ¼ inch).

Although the barrier assembly 10 can be built to scale, in a suitable embodiment the inner most flange 12 and adjoining outer 14 flange comprise heights from about 3.5 cm (about 1⅜ inches) to about 6.35 cm (about 2½ inches). In another embodiment, the adjoining outer 14 flange comprises a height slightly greater than the height of the inner most flange 12. In another embodiment, the inner most flange 12 can be machined so that the height of the inner most flange 12 along or near the inner periphery is less than the height of the inner most flange 12 along or near the outer periphery—as shown in FIG. 1. In a particularly advantageous embodiment, including a bollard 20 configured to extend above grade about 76.2 cm (about 30.0 inches), the height of the inner most flange 12 along its inner periphery is about 2.54 cm (about 1.0 inch) and the height of the inner most flange 12 along its outer periphery is about 5 cm (about 2.0 inches). Likewise, in a particularly advantageous embodiment, including a bollard 20 configured to extend above grade about 76.2 cm (about 30 inches), the height of the adjoining outer flange 14 is about 5 cm (about 2.0 inches).

Although the barrier assembly 10 can be built to scale, in a suitable embodiment the inner diameter of the inner most flange 12 may be from about 8.9 cm (about 3½ inches) to about 25.4 cm (about 10 inches), and the inner diameter of the adjoining outer flange 14 may be from about 10.2 cm (about 4.0 inches) to about 40.6 cm (about 16.0 inches). In a particularly advantageous embodiment, including a bollard 20 configured to extend above grade about 76.2 cm (about 30.0 inches), the inner diameter of the inner most flange 12 is about 17.15 cm (about 6¾ inches), and the inner diameter of the adjoining outer flange 14 is about 28 cm (about 11 inches). Suitably, the adjoining outer flange 14 comprises an outer diameter of up to about 61.0 cm (about 24.0 inches). In addition, one or more sealing rings or O-rings can also be included as part of the multi-flange assembly wherein the one or more sealing rings or O-rings may be configured to fit between at least the inner most flange 12 and the adjoining outer flange 14, suitably within a groove formed along either the outer periphery of inner most flange 12 or along the inner periphery of the adjoining outer flange 14. In a particularly advantageous embodiment, a suitable O-ring includes an outer diameter of about 18.1 cm (about 7⅛ inches).

Furthermore, gasket type material configured to fit between the inner most flange 12 and the bollard 20 can also be added to the barrier assembly 10 to assist in sealing of the barrier assembly 10. In an embodiment of the barrier assembly 10 incorporating gasket type material, a groove can be formed along the inner periphery of the inner most flange 12 that is operationally configured to receive and hold the gasket type material therein. A suitable type gasket material includes for example, ¼ inch TEFLON® gasket material.

The multi-flange assembly of this application may include, for example, any commercially available flange materials such as flanges made from ferrous metals, non-ferrous metals and combinations thereof. In one suitable embodiment, the multi-flange assembly may include flanges made from stainless steel. In a particularly advantageous embodiment, the multi-flange assembly may include slip on type flanges made from 4140 steel. In addition, the flanges described herein may include any weight as required by the particular use of the barrier assembly 10. Although not necessarily limited to a maximum weight, where the flanges are to be manually installed, the flanges may suitably comprise weights up to about 181.4 kg (about 400 lbs), or the alternative, any weight that may be maneuvered by an individual by hand or with light tools.

One advantage of the multi-flange assembly configuration (i.e., the "bulls-eye" configuration of the flanges) is that each flange in the multi-flange assembly is reinforced by each adjoining inner and/or outer flange. In addition, upon impact of a vehicle with a bollard 20 extended above grade, the foundational strength provided by the flange materials in combination with the "bulls-eye" configuration of the multi-flange assembly, is effective to direct or otherwise distribute up to about 100% of the impact energy away from the multi-flange assembly and surrounding ground or support surface immediately surrounding the bollard 20 toward the bollard 20 itself, thereby preserving or maintaining both the multi-flange assembly and the surrounding ground or support surface immediately surrounding the bollard 20 in a substantially unaffected state—eliminating the need to repair or replace the surrounding ground or support surface. By limiting possible impact damage to the bollard 20 only, replacement and/or repair of the barrier assembly 10 is limited to only the retractable assembly or the retractable assembly and the locking assembly. This means that the retractable assembly alone or the retractable assembly and locking assembly attached thereto can be removed from the support assembly and replaced with a new retractable assembly within minutes. In other words, if a bollard 20 is operationally destroyed by an impact, the bollard 20 can be manually replaced with a new bollard 20 within minutes—minimizing the amount of time in which the barrier assembly 10 is inoperative.

To further secure the multi-flange assembly and surrounding ground or support surface, each flange in the multi-flange assembly can be further reinforced by affixing the multi-flange assembly to the framing network of the reinforced cementitious material 15. As seen best in FIGS. 1 and 4, the plane defining the multi-flange assembly is substantially parallel to the surface of the ground 5 wherein up to about 100% of the below grade surface of at least the outer flange 14 can adhere to the reinforced cementitious material 15. In addition, the outer flange 14 can be further affixed to the reinforced cementitious material 15 by joining rebar 33 of the framing network to one or more bolt holes 34 of the outer flange 14 as well as any bolt holes of successive outer flanges. In a particularly advantageous embodiment of the barrier assembly 10 where the multi-flange assembly includes at least an inner most flange 12 and an adjoining outer flange 14, the rebar 33 may be configured to extend from the bolt holes 34 of the outer flange 14 to about the deepest section of the reinforced cementitious material 15, wherein the rebar 33 is in substantially parallel alignment to the longitudinal axis of the housing 18 or casing 16.

Suitably, the reinforced cementitious material 15 configuration, wherein rebar 33 is affixed to the one or more bolt holes 34 of the outer flange 14 and extends or runs into the reinforced cementitious material 15, is effective to stabilize the outer flange 14 against undesired movement and/or destructive movement upon impact between a vehicle and the bollard 20—which assists the multi-flange assembly with directing impact energy toward the part of the bollard 20 extended above grade. Thus, the combination of the multi-flange assembly (i.e., bulls-eye configuration) and the rebar 33 configuration described above may be effective for directing any impact energy toward a bollard 20 (i.e., focusing any impact damage to the bollard 20 only, away from both the ground or surface immediately surrounding the bollard 20 and the multi-flange assembly).

The reinforced cementitious material 15 can comprise any shape, depth and width effective to stabilize or otherwise reinforce the remaining support assembly and retractable assembly, including the locking assembly. In one suitable embodiment of the barrier assembly 10, the reinforced cementitious material 15 may comprise a cylindrical or rectangular shape and surround the housing 18 to a depth below grade that is at least as great as the depth of the retractable assembly when the retractable assembly is in a fully retracted position below grade. In an exemplary embodiment of the barrier assembly 10 including a bollard 20 that extends above grade about 122 cm (about 48 inches) and extends below grade about 25 cm (about 10 inches) when the bollard 20 is in a fully extended position, the reinforced cementitious material 15 suitably extends below grade to a depth of about 168 cm (about 5 feet, 6 3/16 inches).

Suitably, at least one unit of rebar 33 is configured to mate with a single bolt hole 34—depending on the outer diameter or width of the rebar 33. In an embodiment wherein a single unit of rebar 33 is configured to mate with a single bolt hole 34, the number of rebar 33 units utilized can range from one up to the maximum number of bolt holes 34 found on a particular outer flange 14. Typical commercially available flanges comprise from about 8 to about 16 bolt holes 34. Thus, the ultimate number of rebar units used in the barrier assembly 10 depends not only on the outer diameter or width of the rebar 33, but also on the desired strength of the support assembly—wherein each additional rebar 33 unit used effectively adds support strength to not only the support assembly but the entire barrier assembly 10.

In suitable operation, the first end of each rebar 33 unit comprises an outer diameter slightly less than the inner diameter of each bolt hole 34 on a particular flange. The first end of each rebar 33 unit is thus configured to mate with a corresponding bolt hole 34 wherein the rebar 33 can be welded or otherwise affixed within the bolt hole 34. Although the inner diameter of the bolt holes 34 and the outer diameter of the corresponding rebar 33 units may vary, each rebar 33 unit suitably comprises an outer diameter of about 2.54 cm (about 1.0 inch) effective to mate with bolt holes 34 having an inner diameter of up to about 3.81 cm (about 1½ inches).

Figure 4:
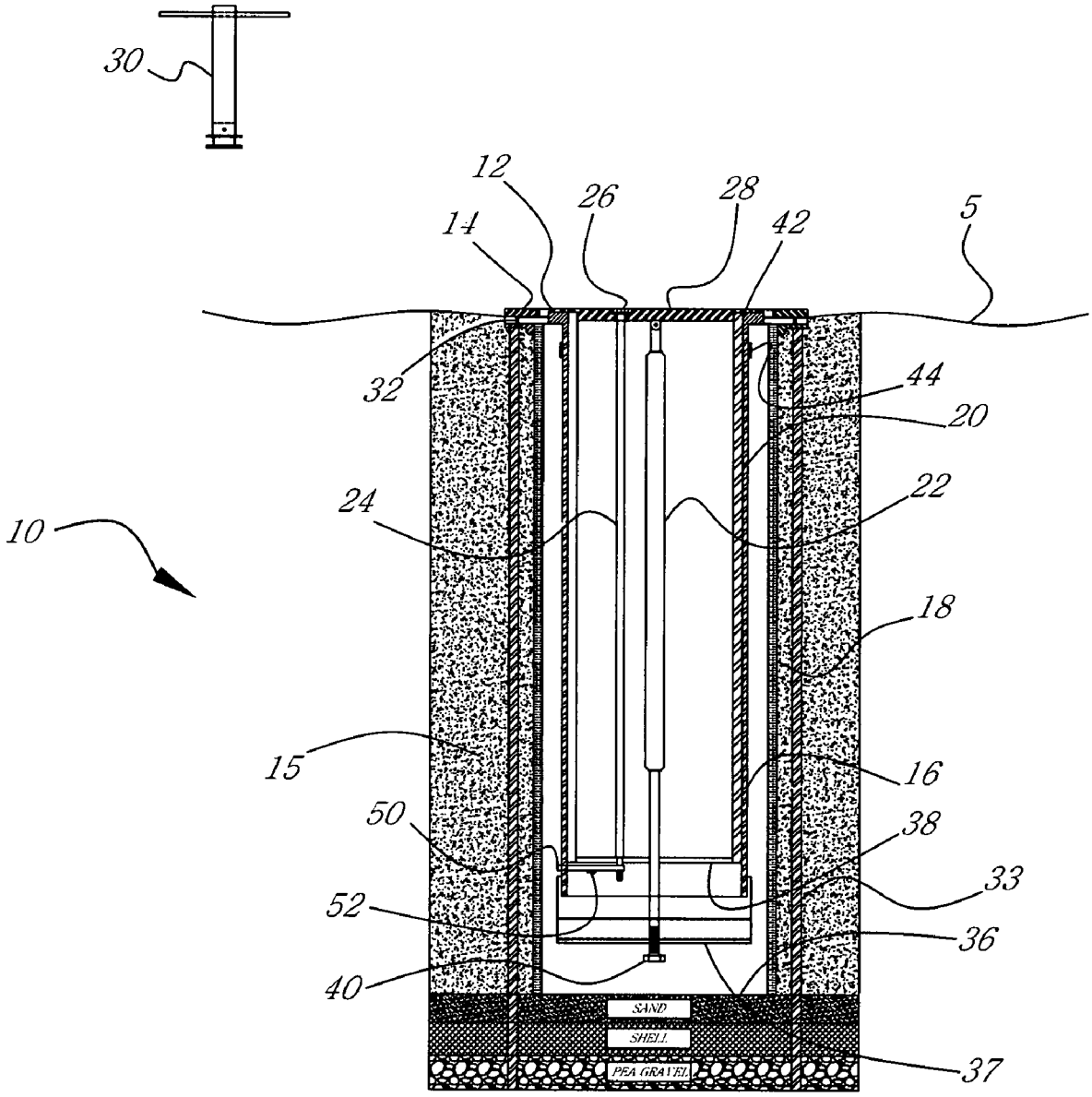
FIG. 4 illustrates a cross-sectional side view of the barrier assembly wherein the bollard is fixed in a retracted position below grade.

In a simplified embodiment as illustrated in FIG. 1, the first end of each rebar 33 unit may be affixed to a correspond bolt hole 34 so that each rebar 33 unit extends below grade in a direction about perpendicular to the plane defining the multi-flange assembly. In one embodiment, each rebar 33 unit may extend below grade about a depth greater than or equal to the maximum length of the bollard 20 used in the barrier assembly 10. In another embodiment, each rebar 33 unit may extend below grade a depth greater than or equal to the depth of housing 18—as seen in FIG. 4. In still another embodiment, each rebar 33 unit may extend below grade a depth less than the depth of housing 18. In a particularly advantageous embodiment including a bollard 20 having a length of about 147.3 cm (about 58.0 inches), each rebar 33 unit suitably extends from the outer flange 14 below grade about 168 cm (about 5½ feet) to form a circular type cage enclosing both the housing 18 and the casing 16.

With reference now to the housing 18 as provided in FIG. 1, the housing 18 suitably includes a configuration effective to isolate the casing 16 from the reinforced cementitious material 15. The housing 18 may also comprise an end cap 36 at a terminal end of the housing 18 that is operationally configured to enclose the housing 18 and seal the casing 16 and retractable assembly, including the locking assembly, from the surrounding environment (i.e., from the ground, water etc.). In one suitable embodiment, the housing 18 is cylindrically shaped and extends below grade to about the depth of the reinforced cementitious material 15. However, the housing 18 may extend below grade a depth greater than or less than the depth of the reinforced cementitious material 15 as desired. In addition to isolating the casing 16 from the reinforced cementitious material 15, the housing 18 may further function as a template on which the reinforced cementitious material 15 can form a uniform foundation as the cementitious material is added to the support assembly around the housing 18. Suitably, the housing 18 is operationally configured to attach to the outer flange 14 either along the below grade side of the outer flange 14 or along either the inner or outer peripheries of the outer flange 14. In a particularly advantageous embodiment, the housing 18 comprises an outer diameter slightly less than the inner diameter of outer flange 14 forming a "slip on" fit or threaded fit configuration between the housing 18 and outer flange 14.

As shown in FIG. 1, the inner diameter of the housing 18 is suitably configured to house at least the casing 16. Although the barrier assembly 10 can be built to scale, a suitable housing 18 comprises an outer diameter of from about 25.4 cm (about 10 inches) to about 41.9 cm (about 16½ inches). In a particularly advantageous embodiment, the outer diameter of the housing 18 is about 27.6 cm (about 10⅞ inches). The housing 18 also comprises a schedule (e.g., wall thickness) necessary to maintain an inner diameter wide enough to receive the casing 16 therein. A suitable housing 18 wall thickness may range from about 0.95 cm (about ⅜ inch) to about 2.54 cm (about 1.0 inch). In a particularly advantageous embodiment, the wall thickness of the housing 18 is about 1.27 cm (about ½ inch). Thus, the inner diameter of the housing 18 is determined, at least in part, by the maximum allowable outer diameter of housing 18 for a particular use and the housing 18 wall thickness.

For the purposes of this application, the housing 18 can be comprised of any material or combination of materials suitable for (1) structural support, (2) housing the casing 16, and (3) sealing the casing 16 and the retractable assembly, including the locking assembly, within the housing 18. Suitable housing 18 materials include, but are not necessarily limited to, those materials resistant to chipping, cracking, excessive bending and reshaping as a result of weathering, heat, moisture, other outside mechanical and chemical influences, as well as impacts to the retractable assembly. Suitable housing 18 materials may include, for example, plastics including polyvinyl chloride ("PVC"), ferrous metals, non-ferrous metals, wood, fiberglass, plexiglass, filled composite materials, and combinations thereof. In a particularly advantageous embodiment, the housing 18 is made of PVC.

As mentioned above, a first end of the casing 16 is suitably configured to affix to the inner most flange 12 and extend there from to a predetermined depth within the housing 18. Suitably, the casing 16 comprises an outer diameter about equal to or greater than the inner diameter of the inner most flange 12 wherein a first end of the casing 16 can be welded or otherwise affixed to the below grade side of inner most flange 12. In a particularly advantageous embodiment, the casing 16 comprises an outer diameter slightly less than the inner diameter of inner most flange 12 wherein a first end of the casing 16 is affixed along its outer periphery to the inner periphery of the inner most flange 12. Once the casing 16 is affixed to the inner most flange 12, the casing 16 and flange 12 operationally become one piece. In one suitable embodiment, the casing 16 can be affixed to the inner most flange 12 by welds. In a particularly advantageous embodiment, the casing 16 can be affixed to the inner most flange 12 by seamless welds. Other means of attachment, including for example, adhesion, screws, rivets and the like are herein contemplated.

Suitable, the casing 16 is operationally configured to receive the retractable assembly, including the locking assembly, below grade. Thus, the casing 16 suitably comprises an inner diameter or width greater than the outer diameter or width of the retractable assembly directed therein. In a particularly advantageous embodiment, the casing 16 is configured to receive a bollard 20 that is substantially centrally aligned along the longitudinal central axis of the casing 16 as the bollard either retracts into the casing 16 or extends above grade. In addition, the casing 16 may further comprise an end cap 37 operationally configured to seal the terminal end of casing 16.

As stated previously, the barrier assembly 10, including the casing 16, can be built to scale. In one suitable embodiment, the outer diameter of the casing 16 can range from about 22.8 cm (about 9.0 inches) to about 40.6 cm (about 16.0 inches). However, it is herein noted that the outer diameter of the casing 16 may be less than about 9.0 inches or greater than about 16.0 inches depending on the use—wherein the outer diameter of the casing 16 is limited by only the inner diameter or width of the corresponding housing 18.

The casing 16 may be constructed from any material or combination of materials effective to provide structural support to the retractable assembly, including for example, those materials resistant to chipping, cracking, excessive bending and reshaping as a result of weathering, heat, moisture, other outside mechanical and chemical influences, and impacts to the retractable assembly. Suitable casing 16 materials include, for example, composite materials, plastics, ferrous metals, non-ferrous metals, and combinations thereof. In a particularly advantageous embodiment, the casing 16 is made from stainless steel.

In a simplified illustration of the casing 16 as seen in FIG. 4, the casing 16 suitably comprises an inner depth great enough to house the retractable assembly, including the locking assembly, when the first end of the retractable assembly is flush with grade. In a suitable embodiment, the casing 16 may comprise an inner depth from about 61.0 cm (about 24.0 inches) to about 127.0 cm (about 50.0 inches). In a particularly advantageous embodiment, the casing 16 may comprise an inner depth of about 102.0 cm (about 40.0 inches). In addition, the casing 16 may comprise an inner diameter from about 12.7 cm (about 5.0 inches) to about 31.75 cm (about 12½ inches). In a particularly advantageous embodiment, the casing 16 may comprise an inner diameter of about 17.5 cm (about 6⅞ inches).

Retractable Assembly

As stated above, the support assembly may be configured to receive a retrievable assembly therein. In particular, the casing 16 of the support assembly may be configured to receive the retractable assembly therein. The retractable assembly described herein suitably comprises at least (1) a bollard 20 operationally configured to extend out from the support assembly to form a barrier above grade; and (2) an actuating member 22 operationally configured to at least urge the bollard 20 to an extended position above grade. Although not limited to any particular shape, a suitable bollard 20 has a cylindrical sidewall including an outer diameter slightly less than the inner diameter of both the casing 16 and the inner most flange 12. In a particularly advantageous embodiment, the barrier assembly 10 may be configured so that the outer sidewall of the bollard 20 is flush with the inner perimeter of the casing 16 and/or the inner most flange 12, wherein the casing 16 and the inner most flange 12 may act to align the bollard 20 along the longitudinal central axis of the casing 16. In addition, the bollard 20 may further comprise a tamper proof cap 28 operationally configured to seal the bollard 20 at a first end and an end cap 38 operationally configured to seal the bollard 20 at a second end.

The tamper proof cap 28 mentioned above suitably comprises an outer diameter greater than the outer diameter of the bollard 20 wherein the tamper proof cap 28 is effective to cover at least part of the inner most flange 12 when the bollard 20 is positioned below grade. In an alternative embodiment, the tamper proof cap 28 may comprise an outer diameter about equal to the outer diameter of bollard 20—as shown in FIG. 2B. As discussed in greater detail below, the tamper proof cap 28 may also be configured to include a locking assembly.

A person of ordinary skill in the art will recognize that since the barrier assembly 10 can be built to scale, the bollard 20 can therefore comprise any length and outer diameter or width as required for a particular use. When used as a barrier for the types of vehicles described herein, the bollard 20 suitably comprises an outer diameter from about 8.90 cm (about 3½ inches) to about 30.5 cm (about 12.0 inches). In a particularly advantageous embodiment, the bollard 20 may comprise an outer diameter of about 17.1 cm (about 6¾ inches). In addition, the bollard 20 further comprises a length effective for at least part of the bollard 20 to extend above grade up to about 1.0 meter (about 39.0 inches). In a particularly advantageous embodiment, the bollard 20 may comprise a length effective for at least part of the bollard 20 to extend above grade about 76.0 cm (about 30.0 inches).

As illustrated in FIGS. 1 and 4, the bollard 20 may be operationally configured to house at least the actuating member 22. In a suitable embodiment, the bollard 20 may be comprised of a hollow member having an inner diameter from about 7.62 cm (about 3.0 inches) to about 27.9 cm (about 11.0 inches). To function as an effective barrier against the impacts herein contemplated, the hollow bollard 20 suitably includes a sidewall thickness from about 0.64 cm (about ¼ inches) to about 5.10 cm (about 2.0 inches). In a particularly advantageous embodiment, a hollow bollard 20 comprises a sidewall thickness of about 0.79 cm (about 5/16 inches).

As stated previously, the barrier assembly 10, including the bollard 20, can be built to scale. In one exemplary embodiment of the barrier assembly 10 including a bollard 20 having a length from about 76.2 cm (about 30.0 inches) to about 101.6 cm (about 40.0 inches), it is desirable that at least part of the bollard 20, from about 15.2 cm (about 6.0 inches) to about 38.1 cm (about 15.0 inches), remain below grade when the bollard 20 is in a fully extended position above grade. By configuring the barrier assembly 10 so that at least part of the bollard 20 remains below grade during operation, the entire bollard 20 can be stabilized or otherwise reinforced by the surrounding support assembly upon impact—as described above. In a particularly advantageous embodiment wherein the bollard 20 includes a length of about 94.0 cm (about 37.0 inches), it is desirable that about 30.48 cm (about 12.0 inches) of the bollard 20 remain below grade when the bollard 20 is in a fully extended position above grade.

As illustrated in FIG. 1, at least one actuating member 22 may be positioned within a hollow bollard 20 wherein the actuating member 22 may be operationally configured to urge the bollard 20 to an extended position. Suitably, the actuating member 22 comprises a gas spring or coil spring configuration effective to not only urge the bollard 20 to an extended position above grade, but a suitable actuating member 22 is also suitably configured so that a user can lock the bollard 20 below grade by manually forcing the bollard 20 below grade (i.e., by pushing on the bollard 20 with hand and/or foot) with minimal resistance from the actuating member 22 as the bollard 20 is forced below grade. In addition, the actuating member 22 may comprise a gas spring releasably attached to the tamper proof cap 28 at a first end and releasably attached to the end cap 37 at a second end. In a particularly advantageous embodiment, the actuating member 22 may comprise a gas spring (1) wherein a first end of the gas spring is operationally configured to thread directly into an aperture on the tamper proof cap 28 (at the below grade side of the tamper proof cap 28) and (2) wherein a second end of the gas spring is operationally configured to releasably attach to an aperture on the end cap 37 via an adjustment bolt 40. Although not necessarily required, the apertures on both the tamper proof cap 28 and the end cap 37 are suitably located about center along each of the caps 28 and 37 (i.e., along the longitudinal central axis of the casing 16) to assist maintaining the alignment of the gas spring parallel to the longitudinal axis of bollard 20.

As mentioned above, a second end of the actuating member 22 may be anchored to an end cap 37 of the bollard 20 via an adjustment bolt 40. In a suitable embodiment, the adjustment bolt 40 may be threaded into an aperture on the end cap 37, wherein the adjustment bolt 40 is then operationally configured to receive a second end of the gas spring—as shown in FIG. 1. It is herein contemplated that the adjustment bolt 40 be effective to position the bollard 20, via incremental movement of the bollard 20, in a manner effective to align the first end of the bollard 20 and/or the tamper proof cap 28 substantially flush with the multi-flange assembly.

It is herein contemplated that the adjustment bolt 40 is not necessarily limited to any one particular type or size, but rather the adjustment bolt 40 may be configured to accommodate or otherwise receive various sizes and shapes of actuating members 22. In addition, a suitable actuating member 22 may be configured to urge a particular bollard 20 any distance or to any desired extended position above grade. Suitable actuating members 22 may be determined, at least in part, by (a) the total weight of the bollard 20 (including the weight of the locking assembly if necessary); and/or (b) the travel time required to urge the bollard 20 from a below grade position to a desired extended position above grade.

A suitable bollard 20 can be made from of any material or combination of materials effective to form a barrier against the type of impacts described herein. Suitable bollard 20 materials include for example, ferrous metals, non-ferrous metals, composite materials, and combinations thereof. In a particularly advantageous embodiment, the bollard 20 is made from stainless steel. Where the bollard 20 is to be used mostly for aesthetic purposes (i.e., to landscape property), a less durable bollard 20 material may be used.

Locking Assembly

A suitable barrier assembly 10 of this application may further include a locking assembly operationally configured to hold or maintain the retractable assembly, or at least the bollard 20, in a fixed position—where the bollard 20 can be maintained either in a fully extended position above grade or maintained in fully a retracted position below grade. It is also herein contemplated that the locking assembly be operationally configured to hold or otherwise maintain the bollard 20 in any intermediate position between a fully extended position and a fully retracted position.

The locking assembly of this application suitably comprises at least (a) a locking rod assembly including at least a locking rod 24 and a locking cam 50 operationally configured to hold the retractable assembly, or at least the bollard 20, in at least a first fixed position; (b) a tamper proof lock 26 operationally configured to maintain the orientation of the locking rod 24 and locking cam 50 against any undesired motion—thus, holding or otherwise maintaining the retractable assembly in a fixed position; (c) a tamper proof cap 28 operationally configured to house the tamper proof lock 26; and (d) a locking tool 30 operationally configured to both remove or detach at least part of the tamper proof lock 26 and adjust the locking rod assembly.

Figure 3:
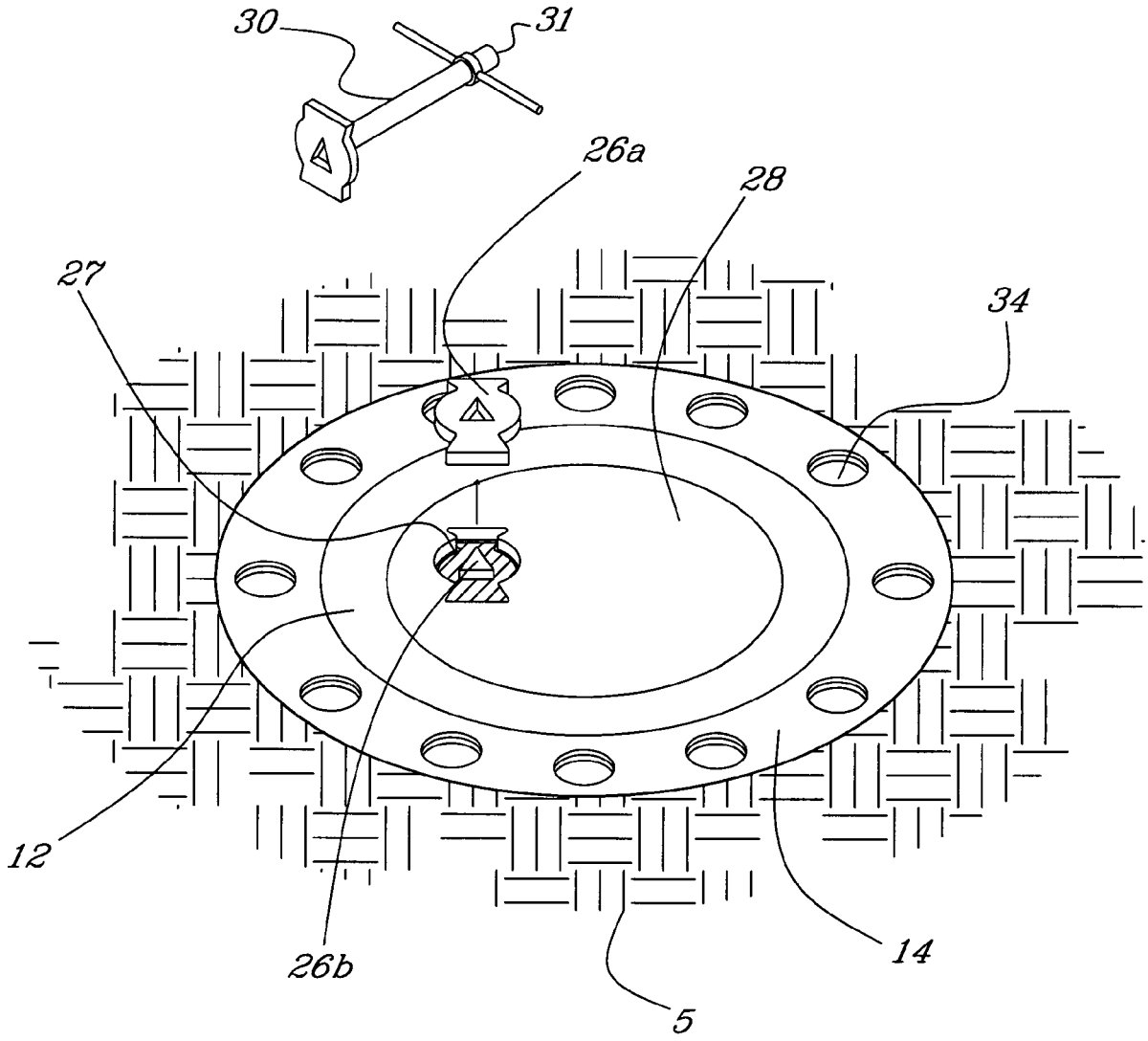
FIG. 3 illustrates a perspective view of the barrier assembly, including a locking assembly, with the bollard positioned below grade.

In a simplified embodiment as illustrated in FIG. 3, the tamper proof lock 26 may comprise at least a removable cover 26*a* and a male member 26*b*. Suitably, the removable cover 26*a* is configured to mate with the male member 26*b* in such a manner that when the removable cover 26*a* is placed in a mated position with the male member 26*b* the outer surface of both the removable cover 26*a* and the male member 26*b* lie flush with the outer surface of the tamper proof cap 28. In addition, as the removable cover 26*a* is removed, detached or otherwise separated from the male member 26*b*, the outer perimeter of the male member 26*b* is exposed so that the male member 26*b* rests in a position within a cavity 27 of the tamper proof cap 28 that is formed by the removal of the removable cover 26*a* from the tamper proof cap 28.

It is herein contemplated that the outer periphery of the removable cover 26*a* and the inner periphery of the corresponding cavity 27 may comprise any number of shapes. In a particularly advantageous embodiment, the outer periphery of the removable cover 26*a* includes a circular main body with two winged edges—as shown in FIG. 2A and FIG. 3. Suitably, the removable cover 26*a* comprises an aperture configured to mate with the male member 26*b* as the removable cover 26*a* is set within the cavity 27 of the tamper proof cap 28.

In a suitable embodiment of the barrier assembly 10, the cavity 27 suitably comprises a non-uniform shape formed on the interior surface of the tamper proof cap 28, wherein the cavity 27 jets out perpendicular to the longitudinal axis of the bollard 20 at a predetermined depth in the cavity 27 resulting in the cavity 27 being greater in diameter or width near its deepest portion than at the part of the cavity 27 near the outer surface of the tamper proof cap 28. Suitably, the diameter of the jetted out portion of the cavity 27 is configured to accommodate the locking tool 30, in particular, the winged edges of the locking tool 30 as discussed in greater detail below. In addition, the jetted out portion of the cavity 27 suitably comprises a clearance to accommodate the height or thickness of the winged edges of the locking tool 30. Thus, in an embodiment including winged edges of the locking tool 30 comprising a height or thickness of about 0.32 cm (about ⅛ inch), the jetted out portion of the cavity suitably comprises a height slightly greater than the height or thickness of the winged edges, for example, a height of about 0.48 cm (about 3⁄16 inches) or more.

During operation of the barrier assembly 10, the male member 26*b* of the tamper proof lock 26 suitably includes a height or length necessary for the male member 26*b* to extend from the deepest section of the cavity 27 to about the outer surface of the tamper proof cap 28 wherein the removable cover 26*a* and male member 26*b* can lie substantially flush with the tamper proof cap 28. Thus, the height or thickness of the removable cover 26*a* is suitably about equal to the height or length of the male member 26*b*. In an alternative embodiment, the height or length of the male member 26*b* may be less than the height or thickness of the removable cover 26*a*, as long as the height or length of the male member 26*b* remains effective for mating with the locking tool 30 to adjust the locking rod assembly as discussed below. For example, where the height or thickness of the removable cover 26*a* and the corresponding depth of the cavity 27 are each about 1.27 cm (about ½ inches), the male member 26*b* can extend from the deepest section of the cavity 27 to about 0.32 cm (about ⅛ inches) from the surface of the tamper proof cap 28 and still be effective for use in conjunction with a locking tool 30 as described herein.

In a suitable embodiment, the male member 26*b* may be releasably attached to a locking rod 24 by any means that is effective for the adjustment of the locking rod via the locking tool 30. In one suitable embodiment, the male member 26*b* may be comprised of a cap configured to snap onto the locking rod 24. In another suitable embodiment, the male member 26*b* can be threaded onto the locking rod 24. In still another suitable embodiment, the male member 26*b* can be permanently attached to the locking rod 24 by incorporating, for example, adhesives such as super glue or welds to permanently attach the male member 26*b* to the locking rod 24.

In certain instances, the shape of the outer perimeter of the male member 26*b* may be determined by the outer shape of the corresponding locking rod 24, or vice versa. Suitably, the aperture of the removable cover 26*a* and the corresponding male member 26*b* comprise shapes effective for adjustment of the locking rod 24. Shapes effective for adjustment of the locking rod 24 may include, for example, common shapes such as rectangular, triangular, hexagonal, octagonal, and oval; as well as aesthetically unique shapes such as star shapes, half-moon shapes, heart shapes, and the like. In a particularly advantageous embodiment, the aperture of the removable cover 26*a* and the corresponding male member 26*b* are each triangular shape—further corresponding to a triangular shaped locking rod 24. Regardless of the shape of the aperture of the removable cover 26*a* and the male member

26*b* to be used, the male member 26*b* is suitably configured to be slightly smaller than the corresponding shape of the aperture of removable cover 26*a*—enabling the removable cover 26*a* to mate with the male member 26*b*.

The removable cover 26*a* described herein may be comprised of any material or combination of materials effective to (a) protect the integrity of male member 26*b*, (b) be removed from the male member 26*b* using the locking tool 30, and (c) camouflage the locking assembly by positioning the removable cover 26*a* flush with the tamper proof cap 28 thereby giving the appearance that the tamper proof cap 28 is one solid continuous piece, or otherwise blending removable cover 26*a* in with the tamper proof cap 28. Suitable removable cover 26*a* materials may include, for example, ferrous metals, non-ferrous metals, composite materials, and combinations thereof. In one embodiment, the removable cover 26*a* may be comprised of ferrous metals effective to be attracted by a magnet. In a particularly advantageous embodiment, the removable cover 26 may be comprised of stainless steel effective to be attracted by a magnet located on the locking tool 30.

As stated above, the tamper proof cap 28 can be configured to house the tamper proof lock 26. Suitably, the tamper proof cap 28 comprises at least one aperture that is operationally configured to receive a first end of a locking rod 24 within the aperture to a point effective for a male member 26*b* to mate with the locking rod 24. In suitable operation, the locking rod 24 may extend the length of the bollard 20 from about the aperture of the tamper proof cap 28 to about an aperture on the end cap 38—as shown in FIG. 1. The aperture on the end cap 38 is suitably configured to receive a second end of the locking rod 24 in a manner effective for the locking rod 24 to extend through the end cap 38 and attach to a locking cam 50 located external of the bollard 20 (i.e., on the exterior side of the end cap 38). Suitably, the locking cam 50 can be rotatably attached to the locking rod 24, which allows the locking cam 50 to turn in response to the rotation of the locking rod 24.

During operation, as the retractable assembly is positioned below grade, the locking cam 50 can be turned by rotating the locking rod 24 so that the locking cam 50 extends underneath the sidewall of the casing 16 thereby effectively locking the bollard 20 below grade. In the alternative, as shown in FIG. 4, the inner sidewall of the casing 16 can comprise a groove or slot operationally configured to receive at least the distal end of the locking cam 50 as the locking cam 50 turns toward the groove or slot. As previously mentioned, the locking cam 50 can be turned by rotating the locking rod 24 so that at least the distal end of the locking cam 50 may extend into the groove or slot of the casing 16 sidewall. A suitable groove or slot includes a depth and width effective to receive and hold a particular locking cam 50 in the casing 16 sidewall—thereby locking the bollard 20 below grade.

In a suitable embodiment, the locking cam 50 may be comprised of any material or combination of materials suitable for mating of the locking cam 50 with the groove or slot on the casing 16 sidewall and for locking or otherwise holding the bollard 20 in a fixed position below grade. Suitable locking cam 50 materials include, for example, metals, plastics, woods, composite materials, and combinations thereof. In a particularly advantageous embodiment, the locking cam 50 is a stainless steel locking cam 50 zinc plated to protect against weathering due to moisture damage and other external or natural influences. In addition, although not limited to a particular length, the locking cam 50 suitably has a length less than the inner diameter or width of the casing 16.

It is contemplated herein that the locking assembly may further comprise a spring 52, including but not necessarily limited to a plunger spring, that is operationally configured to attach to the locking cam 50 to (a) facilitate the desired turning of the locking cam 50, and to (b) assist with maintaining the locking cam 50 in the groove or slot on the casing 16 sidewall to maintain the bollard 20 below grade by absorbing and/or redirecting vibration type energy produced along the above grade side of the bollard 20 on or near the tamper proof cap 28 when the bollard 20 is in a retracted position below grade. For example, when the bollard 20 is retracted below grade, vibration energy may be produced by one or more vehicles traveling near or directly over and contacting the tamper proof cap 28. Thus, the locking assembly described herein is operationally configured to protect the barrier assembly 10 against any undesired unlocking of the bollard 20 as a result vibration energy originating above grade.

With particular reference to FIG. 3, a suitable locking tool 30 may be configured to perform at least one or more of the following functions: (a) detach or otherwise remove the removable cover 26*a* from the tamper proof cap 28; (b) adjust the locking rod 24; (c) assist pulling the retractable assembly to an extended position above grade; and (d) assist forcing the retractable assembly to a position below grade.

In a suitable embodiment of the barrier assembly 10, at least part of the locking tool 30 can be operationally configured to detach or otherwise remove the removable cover 26*a* from the cavity 27 of the tamper proof cap 28. Although not limited to any particular mode of operation, a suitable detaching means may include for example, one or more suction cups configured to attach to the removable cover 26*a*, one or more small hooks configured to catch onto a portion of the removable cover 26*a* to pull the removable cover 26*a* from the tamper proof cap 28, and one or more magnets operationally configured to attract the removable cover 26*a* toward the magnet(s) out from the cavity 27. In a particularly advantageous embodiment, the locking tool 30 itself can be magnetized or configured to include one or more magnets 31 strong enough to attract the removable cover 26*a* out from the cavity 27. Thus, the locking tool 30 alone can be operationally configured to remove the removable cover 26*a* from the tamper proof cap 28 for gaining access to the male member 26*b* to adjust the locking rod 24. Herein, a magnetized locking tool 30 or a locking tool 30 including one or more magnets attached thereto may be referred to as a "mag-lock".

As best illustrated in FIG. 3, at least part of the locking tool 30 may comprise an outer shape corresponding to the shape of the inner periphery of the cavity 27. In addition, the locking tool 30 may further comprise a female member, or aperture, operationally configured to mate with the male member 26*b*. In one suitable mode of operation, the locking tool 30 may be configured so that when mated with the male member 26*b*, the locking tool 30 can be manually rotated thereby acting on the male member 26*b* to further rotate the locking rod 24 to turn the locking cam 50. The locking tool 30 can be also be configured so that the winged ends of the locking tool 30 can turn within the jetted out portion of cavity 27 beyond the diameter of the circular main body portion of the cavity 27 underneath the tamper proof cap 28.

In one suitable implementation of the locking tool 30 starting at the original mating position of the locking tool 30 to the cavity 27 wherein the winged ends of both the locking tool 30 and the cavity 27 are in alignment, the locking tool 30 can be pressed into the cavity 27 to a point where the winged ends of the locking tool 30 can be turned to a position necessary to catch the winged ends of the locking tool 30 on the cavity side of the tamper proof cap 28 as a user pulls on the locking tool 30 in such a manner as to extend the retractable assembly, including the locking assembly, out from the support assembly to an above grade position. As previously mentioned, the locking tool 30 may also be used to force the retractable assembly, including the locking assembly, below grade by mating the locking tool 30 with the cavity 27 so that an individual may apply force to the locking tool 30 to direct the bollard 20 to a retracted position below grade. In order to remove the locking tool 30 from the cavity 27 following either extension or retraction of the bollard 20, the locking tool 30 can simply be rotated so that the winged ends of the locking tool 30 align with the corresponding winged ends of cavity 27 (i.e., the original mating position of the locking tool 30 and cavity 27) and the locking tool 30 can be removed from the cavity 27.

As contemplated herein, the locking tool 30 may be made of any material or combination of materials suitable to accomplish the functions—listed above as functions (a) through (d). Suitable locking tool 30 materials include for example, one or more metals, plastics, woods, composite materials, and combinations thereof, wherein at least a part of the locking tool 30 can be magnetized or wherein the locking tool 30 may include a magnet 31. In a particularly advantageous embodiment, the locking tool 30 is comprised of stainless steel. In addition, the locking tool 30 may comprise any configuration and any size suitable for the manual operation of the locking tool 30. In a suitable embodiment, the locking tool 30 includes a hand held device up to about 35.56 cm (about 14.0 inches) in length. Furthermore, the cavity 27 and the corresponding locking tool 30, including the winged edges, are not limited to any particular dimensions except that the cavity 27 and the corresponding locking tool 30, include a size and width less than the width or diameter of the tamper proof cap 28.

Other technologies, for example, a drainage system for water and the like can be added to the barrier assembly 10 depending on the intended use and location of the barrier assembly 10. In an embodiment including a barrier assembly 10 comprising an upright bollard 20 configuration, a drainage system can be added to the assembly having a layer of at least shell, gravel, sand, and combinations thereof that are set immediately below or near the housing 18—as shown in FIG. 4. In one exemplary embodiment incorporating a drainage system, about the bottom 10.16 cm (4.0 inches) of a hole configured to receive the support assembly can first be filled with shell and gravel and topped off with about 5.10 cm (about 2.0 inches) of sand to furnish the barrier assembly 10 with a drainage system.

Where the ambient environment may reach temperatures near freezing, heat tape may be applied to the casing 16 adjacent the inner most flange 12 to heat the barrier assembly 10 and facilitate operation of the barrier assembly 10. In particular, heat tape may be used to apply heat energy to the casing 16, which results in the melting of any ice or snow on or near the barrier assembly 10. In a suitable embodiment, the heat tape employed may include a 115 AC connection that has been waterproofed at a connection point to the heat tape. In addition, the heat tape may be operationally configured to be controlled by an automatic on/off type switch.

The barrier assembly 10 may also be equipped with one or more spacers placed along the bollard 20 at a point wherein the spacers are operationally configured to maintain the bollard 20 in a substantially parallel alignment to the longitudinal axis of the casing 16 when the bollard 20 is in an extended position above grade. In a suitable embodiment, the one or more spacers may include one or more ball bearings attached near the bottom of the outer wall of the bollard 20. In operation, one or more holes may be formed near the bottom of the outer sidewall of the bollard 20 suitable to receive at least part of the one or more ball bearings therein. Although not limited to a particular number, at least three or more ball bearings are employed to provide a suitable amount of rigidity to the bollard 20 when the bollard 20 is extended above grade. In a particularly advantageous embodiment, three stainless steel ball bearings can be placed within three equally spaced holes near the bottom of the outer sidewall of the bollard 20. Additionally, grease may be applied to each of the ball bearings prior to placing the ball bearings within the equally spaced holes. The grease may aid the turning or rolling of each ball bearing within the equally spaced holes, while also supplying a certain amount of adhesion to defend against any of the ball bearings from falling out of the equally spaced holes as the bollard 20 is being inserted into the support assembly.

In an embodiment of the barrier assembly 10 including a hollow bollard 20 having a wall thickness of about ¼ inch, holes can be formed in the outer sidewall of the bollard 20 to a depth great enough to house up to about half of each ball bearing. Thus, when using ball bearings having a diameter of about 1.60 cm (about ⅝ inch), holes can be formed in the outer wall of the bollard 20 from about 1.0 cm to about 3.0 cm (from about 0.4 inches to about 1.2 inches) in depth. In addition, the equally spaced holes are suitably formed in the bollard 20 sidewall at a point along the length of the bollard 20 that remains below grade when the bollard 20 is set in an extended position above grade.

A person of ordinary skill in the art will recognize that the size of the ball bearings employed may be determined by any number of factors including but not necessarily limited to, the wall thickness of the bollard 20, and the amount of space between the outer wall of the bollard 20 and the inner wall of the casing 16.

A person of ordinary skill in the art will also recognize that the bollard 20 may include any color scheme as desired.

Brief Discussion of the Operation of the Barrier Assembly

In a simplified example of operation of the barrier assembly 10 described herein, the barrier assembly 10 including a bollard 20 operationally configured to extend out from the support assembly to form a barrier above grade can be set in the ground along a target pathway. From a retracted position of the barrier assembly 10 below grade, an individual can use the magnet on the locking tool 30 to separate the removable cover **26*a* from the cavity 27 of the tamper proof cap 28. The locking tool 30 can then be placed within the cavity 27 to rotate the corresponding male member 26*b* to further rotate the locking rod 24 to remove the locking cam 50 from its mating position with the casing 16 sidewall. The bollard 20** can then be extended to form a barrier above grade.

As discussed above, the locking tool 20 can be used to pull the bollard 20 to an extended position above grade. Alternatively, the bollard 20 may include an actuating member 22 operationally configured to urge the bollard 20 to an extended position above grade alone. Once the bollard 20 is extended to a fixed position, the removable cover **26*a* can be reinserted into the cavity 27. To return the bollard 20 below grade, the procedure is reversed, and may require that an individual push on the bollard 20 as describe above in order to completely return the bollard 20** below grade.

As previously mentioned, the barrier assembly 10 of this application is operationally configured to provide rapid removal and replacement of at least the retractable assembly, including the locking assembly, as necessary. For example, in a situation where the bollard 20 has been damaged by impact (i.e., bending of the bollard 20), one or more eye bolts can be secured to the outer surface of the inner most flange 12, and the inner most flange 12 can be release from the adjoining outer flange 14 by removing any locking pins 32 from the inner most flange 12. Once the inner most flange 12 has been released from the adjoining outer flange 14, the inner most flange 12, the casing 16 affixed thereto, and the bollard 20 set within the casing 16 can be removed out from the barrier assembly 10 by pulling on the one or more eye bolts attached to the inner most flange 12. Once removed, a different bollard 20, including a different locking assembly and different actuating member 22, can be inserted into the former inner most flange 12 and casing 16 combination prior to re-installing the former inner most flange 12 and casing 16 back into the barrier assembly 10.

The embodiments described above will be better understood with reference to the following non-limiting examples, which are illustrative only and not intended to limit the present application to a particular embodiment.

EXAMPLE 1

In a first non-limiting example of the barrier assembly 10 disclosed herein, the barrier assembly 10 comprises at least the following approximate dimensions and other features:

| | |
|---|---|
| Casing | |
| Inner Diameter | about 17.78 cm (about 7.0 inches) |
| Outer Diameter | about 19.38 cm (about 7⅝) |
| Length | about 106.7 cm (about 42 inches) |
| Type | Steel |
| Bollard | |
| Inner Diameter | about (about 6.0 inches) |
| Outer | about (about 6⅝ inches) |
| Length | about (about 36 inches) |
| Type | Steel |
| Inner Most Flange | |
| Inner Diameter | about 17.15 cm (about 6¾ inches) |
| Height of body | about 3.81 cm (about 1.5 inch) |
| Height (including recessed ring section) | about 5.08 cm (about 2.0 inches) |
| Type | Slip On Hardened Alloy Steel Flange |
| Gasket to be fitted between the bollard and the Inner Most Flange | TEFLON ® Ring Gasket |
| Locking Pin | |
| Length | about 8.89 cm (about 3½ inches) |
| Outer Diameter | about 1.27 cm (about ½ inch) |
| Type | Dowel Pin |
| Adjoining Outer Flange | |
| Inner Diameter | about 28 cm (about 11 inches) |
| Type | Slip On Hardened Alloy Steel Flange |
| Locking Tool | |
| Length | about 14 inches |
| Type | ¾ steel pipe with a steel cross member. Steel cross member having the following dimensions: Length: about 8.89 cm (about 3½ inches) Outer Diameter: about 0.48 cm (3/16 inches) |
| Magnet | total of two round magnets in base of the locking tool |
| Locking Rod | |
| Length | about 3 feet, 2⅛ inch |
| Outer Diameter | ¾ inch |
| Type | stainless steel |

-continued

| | |
|---|---|
| Actuating member | |
| Type | Gas piston configured for up to about 91.4 cm (about 36 inches) of travel distance |
| Reinforced cementitious material | |
| Type | 200-400 PSI concrete including rebar network |

EXAMPLE 2

In a second non-limiting example, a method of installing the barrier assembly 10 is presented using the following steps:

(1) Starting with a designated location for the barrier assembly 10, an auger is used to dig a hole having the following dimensions:

WIDTH or DIAMETER: about 61 cm (about 24 in)

DEPTH: about 167 cm (about 5½ ft)

(2) The bottom 10.16 cm (4.0 inches) of the hole are filled with shell and gravel and topped off with 5.10 cm (2.0 inches) of sand to furnish drainage to the barrier assembly 10.

(3) A PVC housing 18 having the following dimensions is placed upright within the hole:

INNER DIAMETER: about 25.4 cm (about 10 inches)

OUTER DIAMETER: about 27.5 cm (about 10 15/16 inches)

LENGTH: about 152 cm (about 5 ft)

(4) The outer flange 14 is slipped onto the upper end of the housing 18 wherein the outer flange 14 is set flush at ground level.

(5) Each bolt hole 34 of the outer flange 14 is mated with a unit of rebar 33 to form a rebar cage surrounding the housing 18. Each unit of rebar 33 extends from the outer flange 14 to the bottom of the hole. The rebar 33 is tapped down until the top of the rebar 33 is flush with the outer flange 14 (i.e., level with grade). Each unit of rebar 33 is welded inside the bolt holes 34 and further secured to outer flange 14 by filling the bolt holes 34 with cementitious material. The rebar 33 units have the following dimensions:

DIAMETER: about 29 cm (about 11½ inches)

LENGTH: about 167 cm (about 5½ ft)

(6) A support wire is attached around the housing 18 to provide additional structural support to the housing 18.

(7) The auger dug hole is filled with about 1814 kg (about 4,000 lbs) of cementitious material around the rebar 33 cage to form reinforced cementitious material 15.

(8) The bollard 20 and inner most flange 12 are placed inside of the housing 18 by attaching two one-inch eye bolts to the top of the inner most flange 12 and using the eye-bolts as a means for holding the bollard and inner most flange 12 via a forklift or boom truck.

(9) Two spring loaded locking pins 32 are slid from recesses in the outer flange 14 into corresponding recesses within the inner most flange 12.

(10) The eye-bolts are removed from the inner most flange 12.

EXAMPLE 3

In a third non-limiting example, a method of removing at least the combination of the inner most flange 12, bollard 20 and casing 16 from the remaining barrier assembly 10 wherein the inner most flange 12, bollard 20 and casing 16 collectively weigh about 113.4 kg (about 250 pounds) is presented using the following steps:

(1) Slide two locking pins 32 out from the corresponding recesses of the inner most flange 12.

(2) Thread two one inch eye-bolts into the inner most flange 12.

(3) Turn the eye-bolts clockwise at the same time, the turning of the eye-bolts acting as a jacking mechanism to lift the inner most flange 12, bollard 20 and casing 16 up from a flush position with the outer flange 14 until the O-ring 54 on the outer periphery of the inner most flange 12 clears the surface of outer flange 14.

EXAMPLE 4

In a fourth non-limiting example, a method of operating the barrier assembly 10 is presented using the following steps:

(1) Starting in a locked position wherein the bollard 20 is below grade, the removable cover 26*a* is detached from the tamper proof cap 28 using the magnet 31 of locking tool 30—exposing the male member 26*b*.

(2) The female portion of locking tool 30 is mated with the male member 26*b*.

(3) The male member 26*b* is turned in a first direction to release the locking cam 50 from the casing 16 sidewall which allows the gas spring 22 to urge the bollard 20 to an extended position about 76.0 cm (about 30 inches) above grade.

(4) The male member 26*b* is turned in a second direction to hold the bollard 20 in an extended position via the mating of the locking cam 50 at a second location on the casing 16 sidewall.

(5) The locking tool 30 is stored away.

(6) The removable cover 26*a* is placed back inside the cavity 27 wherein the removable cover 26*a* mates with the male member 26*b*.

(7) The bollard 20 can be subsequently retracted by detaching the removable cover 26*a* from the cavity 27 and using the locking tool 30 to turn the male member 26*b* in the first direction to release the locking cam 50 from the second location on the casing 16 sidewall.

(8) Once the locking cam 50 has been released, the weight of the bollard 20 will cause the bollard 20 to retract to about 15.0 cm (about 6 inches) above grade, wherein an individual can press on the bollard 20 by hand and/or foot pressure to finish retracting the bollard 20 below grade in order to lock the bollard 20.

(9) The locking tool 30 is used to turn the male member 26*b* in the second direction to lock the bollard 20 below grade.

The above steps in Example 4 complete a full cycle of the barrier assembly 10 by extending the bollard 20 from a first locked position below grade to a an extended position above grade and then retracting the bollard 20 back to a locked position below grade.

Persons of ordinary skill in the art will recognize that many modifications may be made to the present application without departing from the spirit and scope of the application. The embodiment(s) described herein are meant to be illustrative only and should not be taken as limiting the invention, which is defined in the claims.

I claim:

1. A barrier assembly comprising:

a support assembly configured to secure to the ground, the support assembly further comprising a multi-flange assembly oriented in a bulls-eye configuration, a housing, a casing, one or more support pins, and reinforced cementitious material;

a retractable assembly configured to be received within the support assembly; and a locking assembly attached to the retractable assembly comprising (a) a locking rod assembly configured to hold the retractable assembly in at least a first fixed position, (b) a tamper proof lock configured to maintain the orientation of the locking rod assembly, and (c) a locking tool configured to access the tamper proof lock and adjust the locking rod assembly so that part of the retractable assembly can be adjusted from the first fixed position below grade to a second fixed position above grade;

wherein the plane defining the multi-flange assembly is substantially parallel to the surface of the ground;

wherein the casing is affixed at a first end to an inner most flange of the multi-flange assembly;

wherein the housing is attached to an outer flange that adjoins the inner most flange, the housing being effective to isolate the casing from the reinforced cementitious material;

wherein the reinforced cementitious material comprises one or more units of rebar joined to the outer flange, whereby the one or more units of rebar extend out from the outer flange in a direction about perpendicular to the plane defining the multi-flange assembly; and wherein the one or more support pins are fixed to the outer flange in a manner effective for the inner most flange to sit atop the one or more support pins during operation of the barrier assembly.

2. The barrier assembly of claim 1, wherein the support assembly comprises a multi-flange assembly including three or more flanges.

3. The barrier assembly of claim 1, wherein the inner most flange is releasably secured to the adjoining outer flange.

4. The barrier assembly of claim 3, further comprising one or more locking pins to secure the inner most flange to the adjoining outer flange.

5. The barrier assembly of claim 1, wherein the adjoining outer flange comprises one or more bolt holes whereby the units of rebar are affixed to the bolt holes of the adjoining outer flange.

6. The barrier assembly of claim 1, wherein the reinforced cementitious material is effective to stabilize the adjoining outer flange against destructive movement upon impact of the retractable assembly by a vehicle.

7. The barrier assembly of claim 1, wherein the housing comprises an outer diameter slightly less than the inner diameter of the adjoining outer flange.

8. The barrier assembly of claim 1, wherein the retractable assembly comprises a bollard.

9. The barrier assembly of claim 8, further comprising an actuating member operationally configured to urge the bollard from a first fixed position to a second fixed position.

10. The barrier assembly of claim 1, wherein the locking tool includes a magnet attached thereto.

11. The barrier assembly of claim 9, further comprising an adjustment bolt to releasably attach the actuating member to the bollard, wherein the adjustment bolt is effective to align a first end of the bollard substantially flush with the multi-flange assembly.

12. The barrier assembly of claim 1, wherein the housing is constructed from plastic.

* * * * *